US006293826B1

(12) United States Patent
Shi et al.

(10) Patent No.: US 6,293,826 B1
(45) Date of Patent: Sep. 25, 2001

(54) ELECTRICAL CONNECTOR WITH METAL SIDE MEMBERS AND METHOD OF PRODUCING SAME

(75) Inventors: GuangXing Shi; Qiang Chen, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,891

(22) Filed: Dec. 28, 2000

(51) Int. Cl.[7] ..... H01R 13/648; H01R 13/405

(52) U.S. Cl. ..... 439/607; 439/736

(58) Field of Search ..... 439/607, 218, 439/217, 221, 223, 224, 78, 79, 74, 108, 701, 736

(56) References Cited

U.S. PATENT DOCUMENTS 5,055,069 * 10/1991 Townsend et al. ..... 439/608
5,478,259 * 12/1995 Noschese ..... 439/607
5,562,499 * 10/1996 Minich ..... 439/620
6,155,886 * 12/2000 Koseki et al. ..... 439/736
6,186,807 * 2/2001 Simmel ..... 439/218

* cited by examiner

*Primary Examiner*—Brian Sircus
*Assistant Examiner*—Chandrika Prasad
(74) *Attorney, Agent, or Firm*—Wei Te Chung

(57) ABSTRACT

An electrical connector (100) comprises a housing (1), a number of terminals (2) retained in the housing, and a pair of metal walls (30) secured to the housing, and a pair of metal soldering pads (33). The housing includes a base (10), a mating board (12), and a pair of sidewalls (11) adjoining the base. Each sidewall is bridged to the base by a plurality of ribs (119). Each metal wall defines a plurality of slits (31), through which the ribs extend to retain the metal walls to the base. Only one insert molding process is required to manufacture the connector. During the high-temperature process of soldering the soldering pads to a printed circuit board, the metal walls strengthen the base and the sidewalls. Longitudinal distortion of the base and the sidewalls is thereby minimized. Accordingly, coplanarity of the terminals and quality of soldering is maximized.

11 Claims, 6 Drawing Sheets

ELECTRICAL CONNECTOR WITH METAL SIDE MEMBERS AND METHOD OF PRODUCING SAME

BACKGROUND OF THE INVENTION

1. Field of the Invention

The present invention relates to an electrical connector, and particularly to an electrical connector with metal members located at lateral sides of a housing of the connector for improving coplanarity of terminals of the connector.

2. Brief Description of the Related Art

A conventional connector usually includes a base with a plurality of terminals insert molded on a tongue board, and a pair of insulative sidewalls which project upwardly from lateral sides of the base and are parallel to the tongue board. The base is insert molded with the terminals, and then the sidewalls are insert molded to the base. This two-step insert molding procedure is unduly time-consuming and costly. Moreover, the plastic sidewalls acquire stresses during the second insert molding step. When the terminals are subsequently soldered to a printed circuit board, the sidewalls longitudinally deform to dissipate the stresses. Coplanarity of the terminals is degraded, and thus the quality of soldering is reduced.

Hence, an improved electrical connector is required to overcome the disadvantages of the prior art.

BRIEF SUMMARY OF THE INVENTION

A main object of the present invention is to provide an electrical connector with a pair of metallic walls for insuring coplanarity of terminals of the connector.

Another object of the present invention is to provide an electrical connector which is quickly and cost-efficiently manufactured.

To achieve the above-mentioned objects, an electrical connector in accordance with a first embodiment of the present invention includes a dielectric housing, a plurality of terminals retained in the housing, and a pair of metal members secured to the housing. Each metal member has a metal wall secured in the base and a metal soldering pads extending from the metal wall for soldering to a printed circuit board.

The housing includes a base, a mating board projecting upwardly from the base for engaging with a complementary connector, and a pair of sidewalls adjoining the base. A plurality of ribs extends from each lateral side of the base to the corresponding sidewall through a plurality of slits defined in each metal wall. Only one insert molding process is required to manufacture the connector. During the high-temperature process of soldering the soldering pads of the connector to the printed circuit board, the metal members support any melting plastic. Longitudinal distortion of the base and the sidewalls is thereby minimized. Accordingly, coplanarity of the terminals and quality of soldering is maximized.

Other objects, advantages and novel features of the present invention will become more apparent from the following detailed description of the preferred embodiments when taken in conjunction with the accompanying drawings.

DETAILED DESCRIPTION OF THE PREFERRED EMBODIMENTS

Figure 1:
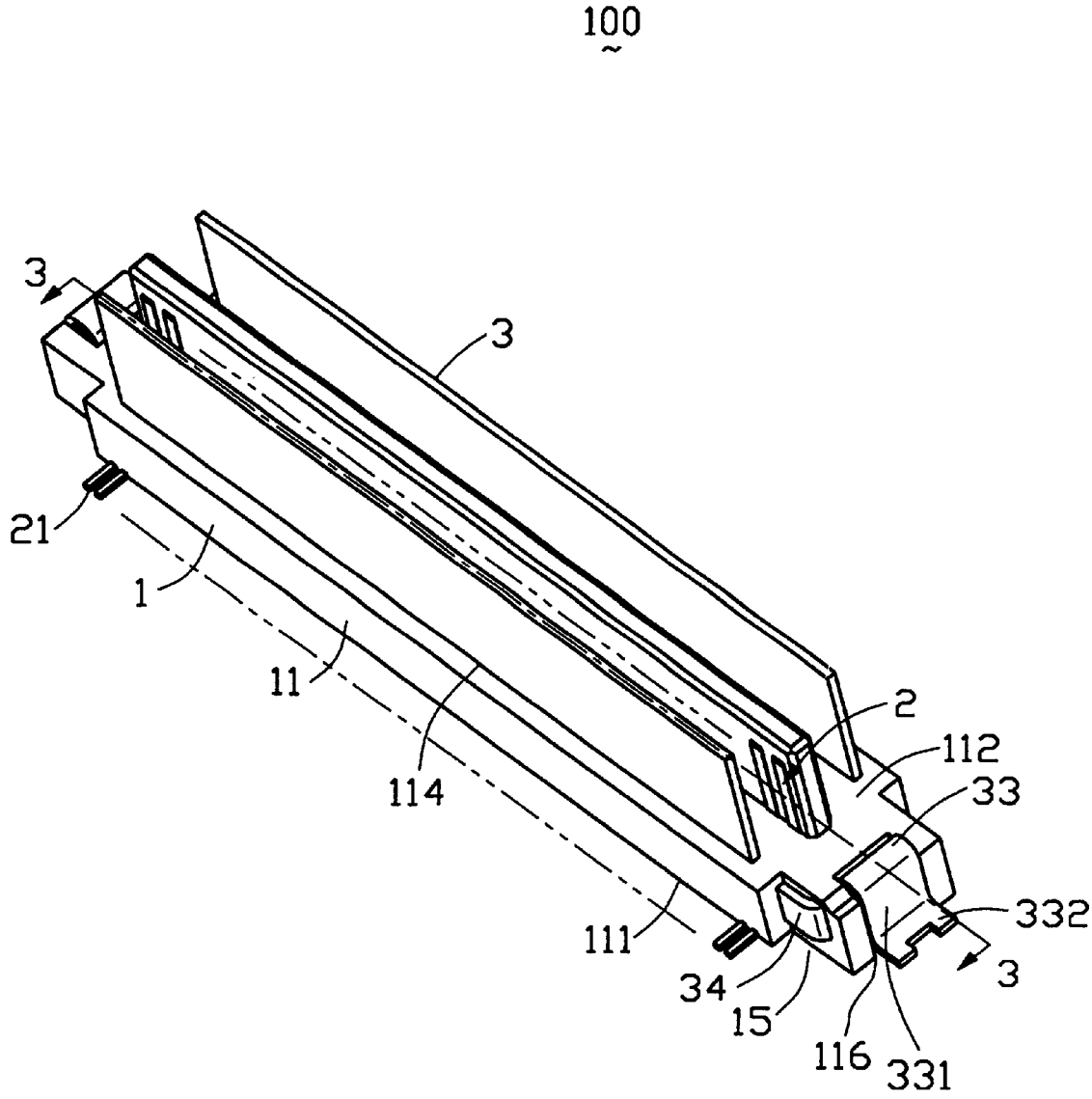
FIG. 1 is a perspective view of an electrical connector in accordance with a first embodiment of the present invention.
Figure 2:
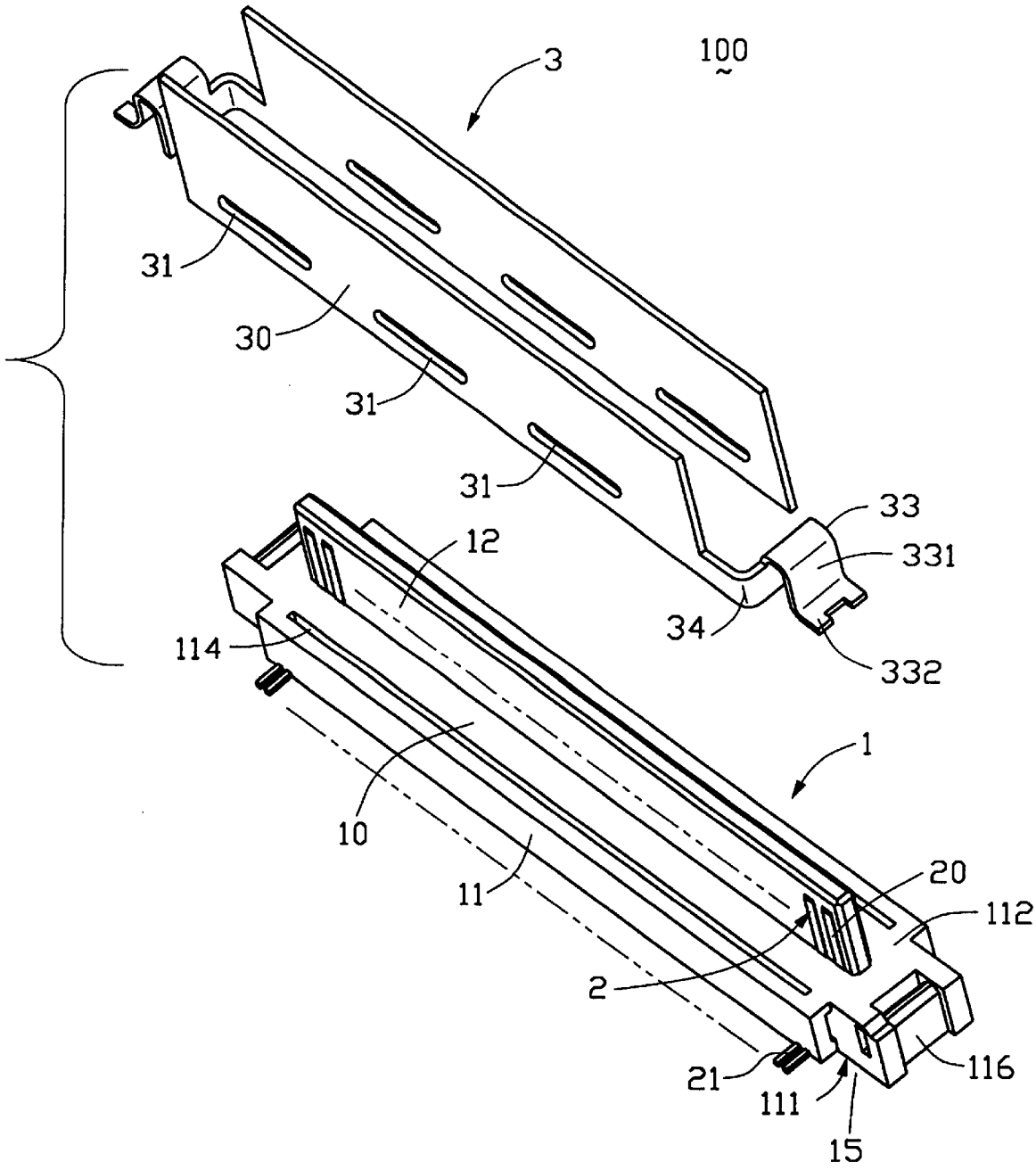
FIG. 2 is a perspective view of the connector of FIG. 1, showing a pair of metal members separated from a housing of the connector.

Referring to FIGS. 1 and 2, an electrical connector 100 in accordance with a first embodiment of the present invention comprises a dielectric housing 1, a plurality of terminals 2 secured in the housing 1, and a pair of metal members 3. The terminals 2 and the metal members 3 are integrally molded within the housing 1. For clarity, the metal members 3 are separated from the housing 1 in FIG. 2.

The housing 1 defines a base 10, a pair of sidewalls 11 located at lateral sides of the base 10, and a mating board 12 projecting upwardly from the base 10. The terminals 2 each include a mating end 20, and are arrayed along opposite sides of the mating board 12 for engaging with contacts of a complementary connector (not shown). Each terminal 2 also includes a soldering tail 21 protruding outwardly from the corresponding sidewall 11, for soldering to a printed circuit board (not shown).

The base 10 defines a mounting surface 111 for abutting against a printed circuit board (not shown), and an engaging surface 112 opposite the mounting surface 111. A pair of U-shaped recesses 116 is respectively defined at opposite ends of the base 10.

Figure 3:
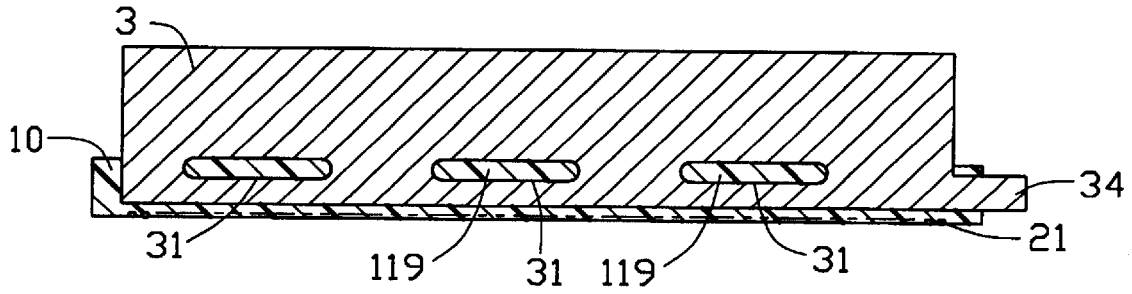
FIG. 3 is a cross-sectional view taken along line 3—3 of FIG. 2.

The sidewalls 11 are the same height as the base 10. Each sidewall 11 together with a lateral side of the base 10 defines a channel 114 in the engaging surface 112. The channels 114 communicate respectively with the recesses 116 by openings 15. Furthermore, the sidewalls 11 form a plurality of ribs 119 (see FIG. 3). The ribs 119 bridge the base 10 with the corresponding sidewalls 11 across the respective intervening channels 114.

Each metal member 3 comprises an elongate wall 30, a bridge 34, and a soldering pad 33 connected to the wall 30 by the bridge 34. The wall 30 defines three slits 31 near a lower edge thereof. Each soldering pad 33 includes a U-shaped transition section 331 and a soldering section 332.

In manufacturing, the connector 100 is produced in a single insert molding. Firstly, metal pins and a pair of metal plates are positioned in a mold using tools. Secondly, molten plastics is injected into the mold to form the dielectric housing 1. Then, the metal pins are secured along opposite sides of the mating board 12 to form the terminals 2 and the metal plates are secured in the base 10 to form the metal members 3. The metal members 3 are insert molded in the housing 1 such that the slits 31 of the walls 30 are located in the channels 114, and are filled with the ribs 119 which join the base 10 with the sidewalls 11. The ribs 119 thus retain the walls 30 in position, and provide a path between the sidewalls 11 and the base 10 to enable insert molding of the housing 1. Moreover, the ribs 119 strengthen the link between the sidewalls 11 and the base 10, thus reducing the possibility of the sidewalls 11 splitting away from the base 10. The soldering pads 33 are positioned on the base 10 by means of the transition sections 331 being received in the recesses 116, the soldering sections 332 thereupon being flush with the mounting surface 11 for soldering to the printed circuit board. The walls 30 can engage with a grounded shield of the complementary connector to provide shielding to the terminals 2. Thus the metal walls 30 not only function to guide insertion of a complementary connector into the connector 100, but also function to shield the terminals 2. Since the connector 100 is manufactured by just one insert molding, production of the connector 100 is highly efficient and economical.

The terminals 2 are soldered to the printed circuit board under a temperature about 200C. At this temperature, the longitudinally extending metal members 3 support the housing 1. Thus longitudinal distortion of the housing 1 is effectively minimized, thereby ensuring coplanarity of terminals 2.

Figure 4:
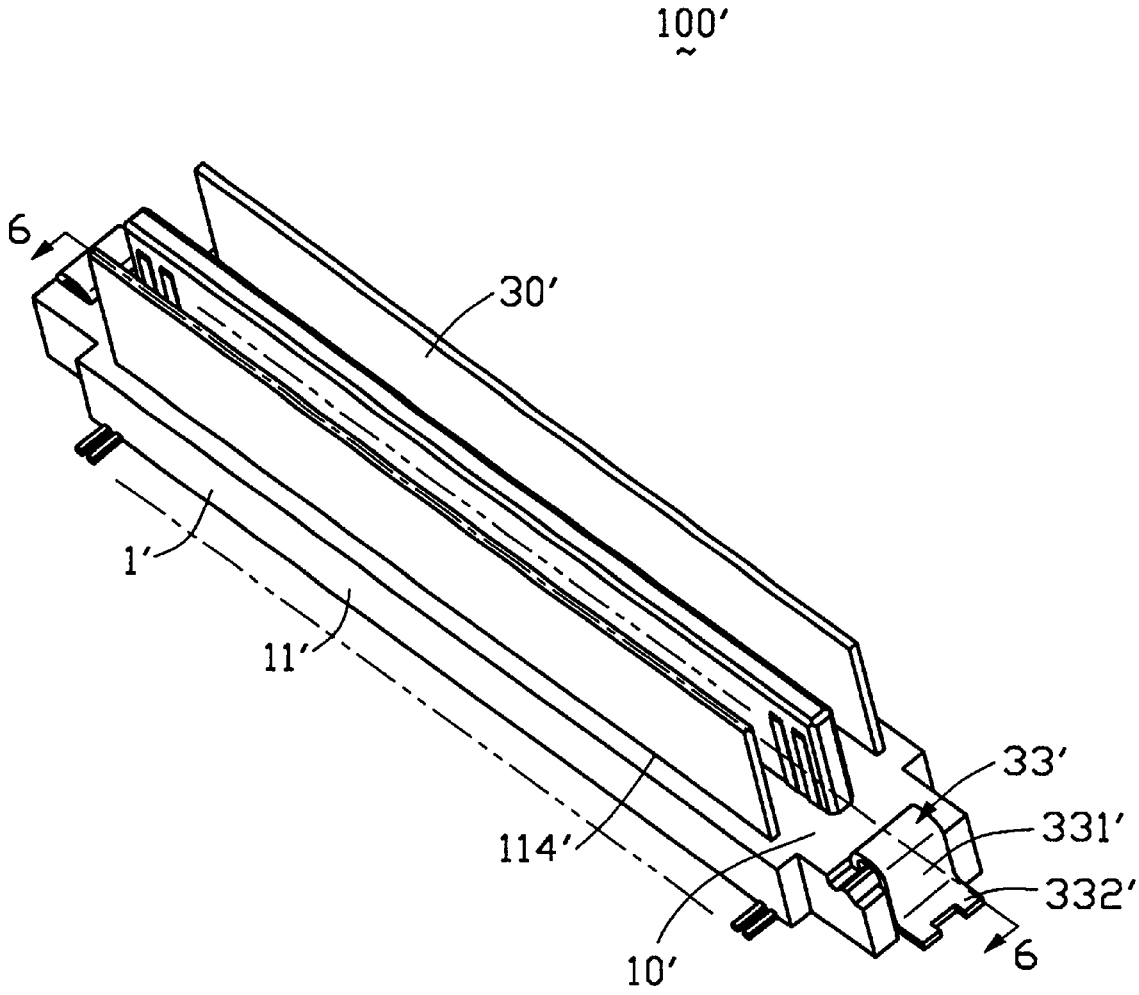
FIG. 4 is a perspective view of an electrical connector in accordance with a second embodiment of the present invention.
Figure 5:
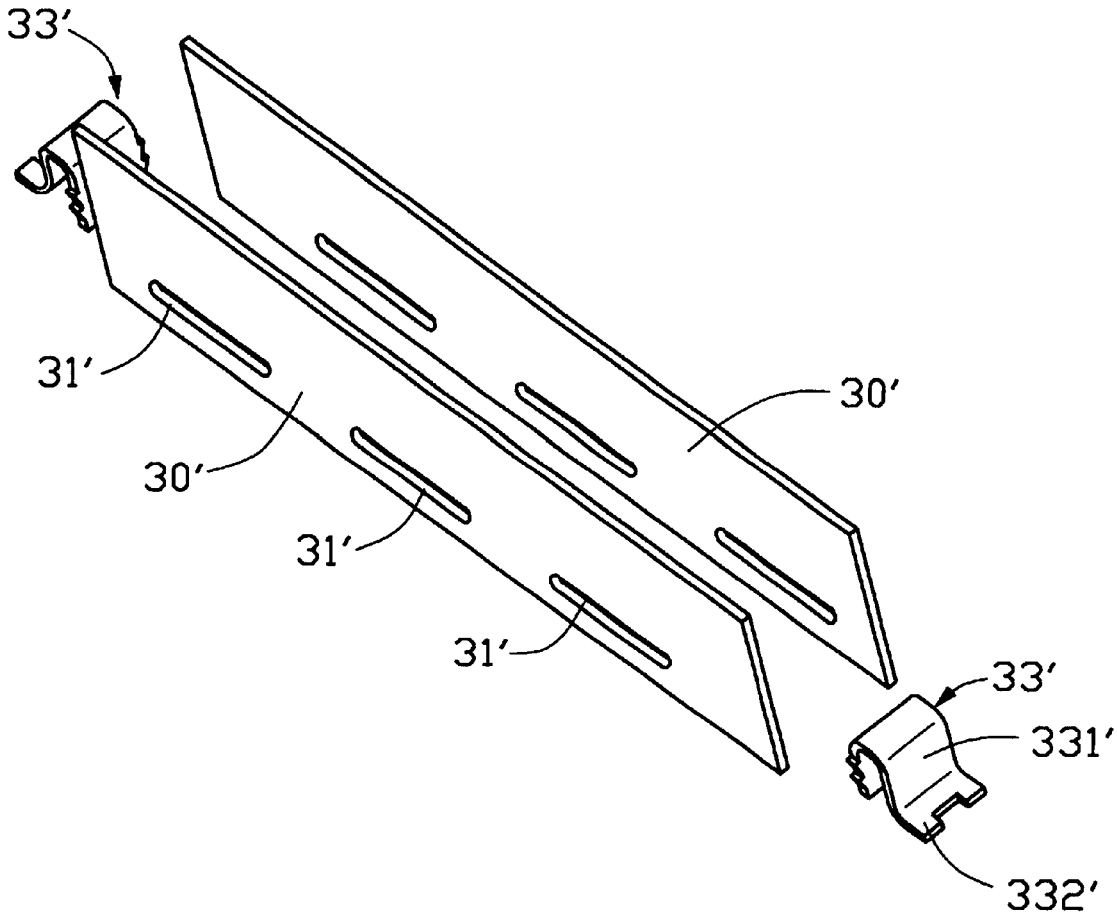
FIG. 5 is a perspective view of a pair of metal walls and a pair of soldering pads of FIG. 4.
Figure 6:
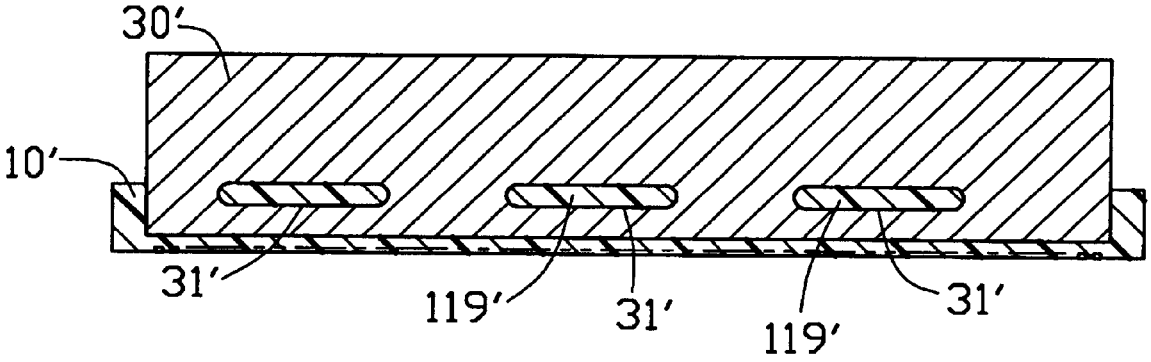
FIG. 6 is a cross-sectional view taken along line 6—6 of FIG. 4.

Referring to FIGS. 4–6, a connector 100' in accordance with a second embodiment of the present invention is essentially similar to the connector 100. Numerals in FIGS. 4–6 which are similar to numerals in FIGS. 1–3 designate elements in FIGS. 4–6 which are similar to elements in FIGS. 1–3. The connector 100' comprises a dielectric housing 1', and a pair of metal members 3'. Each metal member 3' comprises an elongate wall 30' and a soldering pad 33'. The soldering pad 33' is isolated from the wall 30'.

The housing 1' includes a base 10' and a pair of lateral sidewalls 11'. Each wall 30' is insert molded between the base 10' and the sidewalls 11', and defines a plurality of slits 31' near a lower edge thereof. Referring particularly to FIG. 6, a plurality of ribs 119' extends through the slits 31' to bridge the base 10' with the corresponding sidewalls 11' across respective intervening channels 114. Each soldering pad 33' includes a U-shaped transition section 331' and a soldering section 332' for soldering to a printed circuit board (not shown). The soldering pads 33' form a plurality of barbs at lateral edges thereof, for interferingly retaining the soldering pads 33' in the base 10'. Such means of retention will be apparent to those skilled in the relevant art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounting on a printed circuit board for mating with a complementary connector, comprising:

a dielectric housing including a base, a mating board projecting upwardly from the base for engaging with the complementary connector, and a pair of sidewalls adjoining lateral sides of the base;

a plurality of terminals having mating ends arranged along opposite sides of the mating board for electrically engaging with contacts of the complementary connector, and soldering tails extending outwardly beyond the sidewalls for soldering to the printed circuit board;

a pair of metal,walls secured between the base and the sidewalls and projecting upwardly from the base, each wall having a plurality of slits in the portion of the wall embedded within the housing; and a pair of soldering pads located at opposite ends of the base for soldering the connector to the printed circuit board.

2. The electrical connector as claimed in claim 1, wherein a plurality of ribs extends from lateral sides of the base to the sidewalls through the slits of the walls, for positioning the walls and for insert molding of the base and the sidewalls.

3. The electrical connector as claimed in claim 2, wherein the soldering tails outwardly extend beneath the walls.

4. The electrical connector as claimed in claim 2, wherein the walls are connected to the soldering pads by bridges, such that during manufacturing of the connector tools grasp the bridges to position the walls and the soldering pads.

5. The electrical connector as claimed in claim 4, wherein the walls and the soldering pads are insert molded to the base.

6. The electrical connector as claimed in claim 1, wherein the walls are separate from the soldering pads, the metal walls being insert molded to the base but the soldering pads being interferingly retained on the base.

7. A method of producing an electrical connector, said connector having a base, an elongated mating board upwardly projecting from the base, a plurality of terminals fixed to at least one side of the mating board for electrically engaging with a complementary connector, each terminal having a soldering tail extending beyond a mounting surface of the base for soldering to a printed circuit board, and at least one elongated metal wall upwardly projecting from the base beside the mating board for guiding the connector to mate with the complementary connector, the method comprising:

A) positioning a metal plate and a plurality of metal pins in a mold; and

B) injecting molten plastics into the mold to form the base and the mating board of the connector, in which the metal pins attached to at least one side of the mating board to form the terminals of the connector and the metal plate having a lower portion embedded in the base and an upper portion forming the metal wall of the connector.

8. The method in accordance with claim 7, wherein at least a slit is defined in the lower portion of the metal plate through which the molten plastics flows so that a rib is formed in the base engaging with the metal plate.

9. The method in accordance with claim 7, wherein the metal plate is integrally formed with a solder plate at a lateral side thereof which is located outside the base for soldering to the printed circuit board.

10. The method in accordance with claim 7, wherein step A further comprises positioning a solder pad in the mold which has a first portion embedded in the base and a second portion located outside the base for soldering to the printed circuit board.

11. An electrical connector comprising:

a dielectric housing including a base, a mating board extending upwardly from said base, and a pair of sidewalls adjoining lateral sides of the base;

a plurality of terminals disposed in the base;

two substantially identical metal pieces symmetrically retained to the housing by insert-molding, and commonly surrounding the mating board, each of said metal pieces including a metal plate extending through the corresponding sidewall, and solder pads located at two opposite ends of the housing; wherein said metal plate and said solder pad are connected by a bridge.

* * * * *